US010991522B2

(12) United States Patent
Nakao et al.

(10) Patent No.: US 10,991,522 B2
(45) Date of Patent: Apr. 27, 2021

(54) MOVABLE CONTACT POINT, SWITCH WITH MOVABLE CONTACT POINT, AND EMBOSSED TAPE FOR CONTAINING MOVABLE CONTACT POINT

(71) Applicant: Panasonic Intellectual Property Management Co., Ltd., Osaka (JP)

(72) Inventors: Ryosuke Nakao, Okayama (JP); Koji Nishikawa, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/642,772

(22) PCT Filed: Nov. 28, 2018

(86) PCT No.: PCT/JP2018/043678
§ 371 (c)(1),
(2) Date: Feb. 27, 2020

(87) PCT Pub. No.: WO2019/130955
PCT Pub. Date: Jul. 4, 2019

(65) Prior Publication Data

US 2020/0411255 A1 Dec. 31, 2020

(30) Foreign Application Priority Data

Dec. 26, 2017 (JP) ..... JP2017-249169
Dec. 26, 2017 (JP) ..... JP2017-249170

(51) Int. Cl.
*H01H 13/14* (2006.01)

(52) U.S. Cl.
CPC ..... *H01H 13/14* (2013.01)

(58) Field of Classification Search
CPC ..... H01H 13/14; H01H 13/83; H01H 13/702; H01H 13/705
See application file for complete search history.

(56) References Cited

U.S. PATENT DOCUMENTS 4,194,105 A * 3/1980 Hodges ..... H01H 13/48 200/275
4,794,215 A * 12/1988 Sawada ..... H01H 13/06 200/512

(Continued)

FOREIGN PATENT DOCUMENTS

DE 102005037613 A1 2/2007
DE 102007062907 B3 3/2009

(Continued)

OTHER PUBLICATIONS

International Search Report of PCT application No. PCT/JP2018/043678 dated Mar. 5, 2019.

(Continued)

*Primary Examiner* — Kyung S Lee
(74) *Attorney, Agent, or Firm* — McDermott Will & Emery LLP

(57) ABSTRACT

A movable contact includes a conductive member having an outer end having substantially a rectangular shape when viewed from above the conductive member. The conductive member includes a dome portion, a flange extending in a direction away from the dome portion, a connection portions provided at each of four corners of the rectangular shape, and a contact portion extending away from the flange. The connection portion, a first boundary portion where the connection portion is connected to the flange, and a second boundary portion where the connection portion is connected to the contact portion may constitute a drawn portion.

(Continued)

Alternatively, the first and second boundary portions may be curved to be concave toward the dome portion.

26 Claims, 11 Drawing Sheets

(56) References Cited

U.S. PATENT DOCUMENTS

| | | | | |
|---|---|---|---|---|
| 7,075,025 | B2 * | 7/2006 | Tomitsuka | H01H 13/7006 200/512 |
| 7,829,812 | B2 * | 11/2010 | Tolbert | H01H 13/702 200/600 |
| 8,759,704 | B2 * | 6/2014 | Inamoto | H01H 13/85 200/406 |
| 2007/0039809 | A1 * | 2/2007 | Aihara | H01H 13/83 200/310 |
| 2011/0000775 | A1 * | 1/2011 | Itou | H01H 13/705 200/520 |
| 2012/0055773 | A1 * | 3/2012 | Nakaoka | H01H 13/88 200/512 |
| 2012/0145526 | A1 * | 6/2012 | Masuda | H01H 13/705 200/513 |
| 2013/0270093 | A1 * | 10/2013 | Nakaoka | H01H 13/04 200/521 |
| 2018/0218854 | A1 * | 8/2018 | Miyamoto | H01H 13/04 |

FOREIGN PATENT DOCUMENTS

| | | |
|---|---|---|
| DE | 102007062901 B3 | 5/2009 |
| JP | 7-041040 | 2/1995 |
| JP | 7-027033 U | 5/1995 |
| JP | 11-144558 | 5/1999 |
| JP | 2001-076568 | 3/2001 |
| JP | 2001-110268 | 4/2001 |

OTHER PUBLICATIONS

Partial European Search Report (R.164 EPC) dated Jan. 11, 2021 for the related European Patent Application No. 18897792.0.

* cited by examiner

MOVABLE CONTACT POINT, SWITCH WITH MOVABLE CONTACT POINT, AND EMBOSSED TAPE FOR CONTAINING MOVABLE CONTACT POINT

CROSS-REFERENCE TO RELATED APPLICATIONS

This application is a U.S. national stage application of the PCT international application No. PCT/JP2018/043678 filed on Nov. 28, 2018, which claims the benefit of foreign priority of Japanese patent application No. 2017-249169 filed on Dec. 26, 2017 and Japanese patent application No. 2017-249170 filed on Dec. 26, 2017, the contents all of which are incorporated herein by reference.

TECHNICAL FIELD

The present invention relates to a movable contact used for, e.g. a push switch, a switch with the movable contact, and an embossed tape for accommodating the movable contact.

BACKGROUND ART

A conventional movable contact disclosed in PTL 1 includes a dome portion which is convex toward a first surface, a flange, and a contact portion. The dome portion is convex from the flange toward the first surface. The contact portion is bent from the flange to an opposite side to the first surface. The outer shape of the movable contact is rectangular when viewed from the first surface. The contact portion is provided at each of four corners of the movable contact.

This movable contact is manufactured by metal stamping. The contact portion is formed by bending from the flange. In this case, in the bending, the shape of a bent portion that is a boundary between the flange and the contact portion is straight.

The movable contact functions as a switch while the movable contact contacts and is separated from a fixed contact portion formed on the bottom of a base of the switch or a printed circuit board. The fixed contact portion includes a first fixed contact and a second fixed contact that contacts the contact portion of the movable contact. Then, by pushing the dome portion, the dome portion is inverted and contacts the first fixed contact.

Another conventional movable contact disclosed in PTL 2 includes a dome portion and protrusion portions. The shape of the dome portion when viewed from the front side is a circle. The dome portion is convex from the protrusion portion to one side. The protrusion portions extend from an outer border of the dome portion in directions opposite to each other. The movable contact is mounted on a wiring board. A switch is configured by a fixed contact formed with a conductor pattern on the wiring board and the movable contact mounted on the wiring board. In order to configure a switch on the wiring board, the movable contact is mounted on the wiring board by a general-purpose component mounting machine. For mounting by the component mounting machine, the movable contact is accommodated in an embossed tape.

The embossed tape for accommodating the above conventional movable contact has a circular recess that accommodates the dome portion therein. In order to mount the movable contact on the wiring board accurately by the component mounting machine, it is necessary to regulate the position and the angle of the movable contact in the embossed tape accurately. Therefore, the embossed tape has a rectangular recess portion that accommodates the protrusion portion therein, and the angle of the dome portion is regulated by contacting the protrusion portion on the side surface of the rectangular recess portion.

CITATION LIST

Patent Literature

PTL 1: Japanese Patent Laid-Open Publication No. 11-144558

PTL 2: Japanese Patent Laid-Open Publication No. 2001-110268

SUMMARY

A movable contact includes a conductive member having an outer end having substantially a rectangular shape when viewed from above the conductive member. The conductive member includes a dome portion, a flange extending in a direction away from the dome portion, a connection portions provided at each of four corners of the rectangular shape, and a contact portion extending away from the flange. The connection portion, a first boundary portion where the connection portion is connected to the flange, and a second boundary portion where the connection portion is connected to the contact portion constitute a drawn portion. Alternatively, the first and second boundary portions are curved to be concave toward the dome portion.

An embossed tape is configured to accommodate the movable contact therein. The movable contact further includes an extension portion protruding from the conductive member and a mounting portion connected to the extension portion. The embossed tape includes a base tape having an upper surface having an accommodation recess portion provided therein. The accommodation recess portion is configured to accommodate the movable contact therein. The accommodation recess portion includes a first recess portion, a receiving portion, a second recess portion, and a regulator portion. The first recess portion has a first bottom surface and a first side wall connected to the first bottom surface. The first recess portion is configured to accommodate the flange of the movable contact therein. The receiving portion is provided on the first bottom surface of the first recess portion, and is configured to receive the flange of the movable contact thereon. The second recess portion has a second bottom surface and a second side wall connected to the second bottom surface. The second recess portion is connected to the first recess portion, and is configured to accommodate the extension portion and the mounting portion of the movable contact therein. The regulator portion is provided on the first side wall of the first recess portion, and is configured to regulate a position of the contact portion of the movable contact. A gap between the contact portion and the regulator portion is smaller than a gap between the extension portion and the second side wall of the second recess portion and a gap between the mounting portion and the second side wall of the second recess portion.

The movable contact accommodated in the embossed tape is prevented from deforming.

DETAIL DESCRIPTION OF PREFERRED EMBODIMENT

Figure 1:
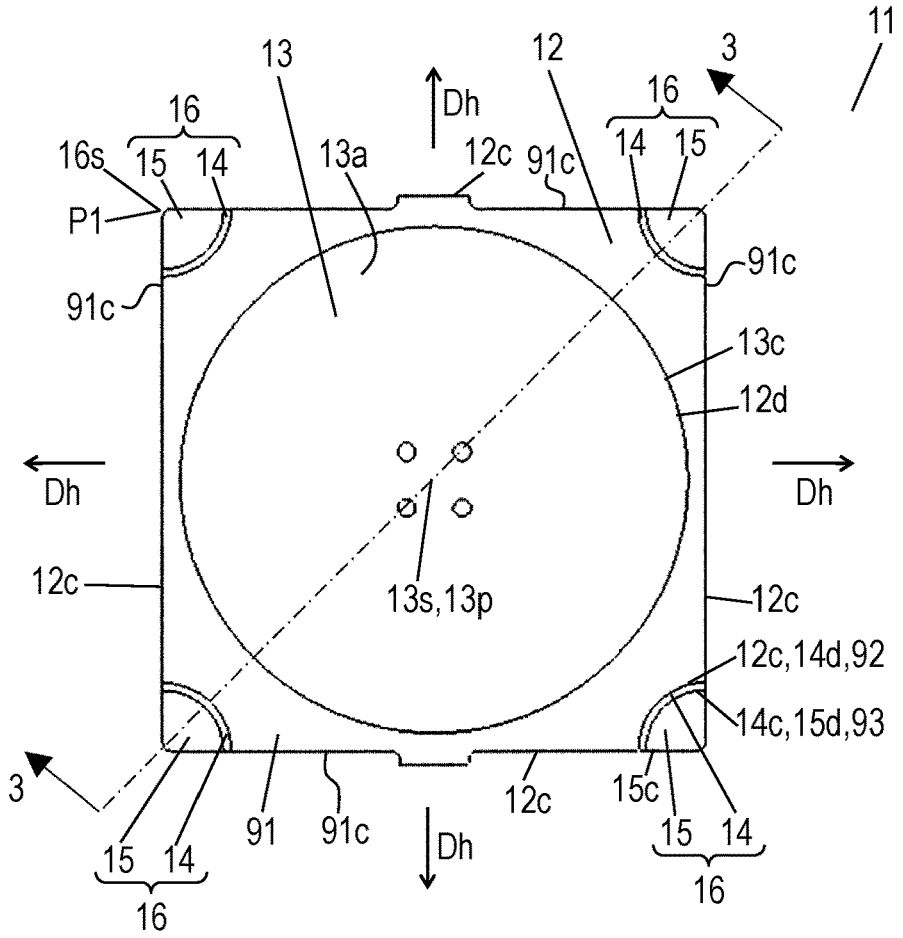
FIG. 1 is a top view of a movable contact according to an exemplary embodiment.
Figure 2:
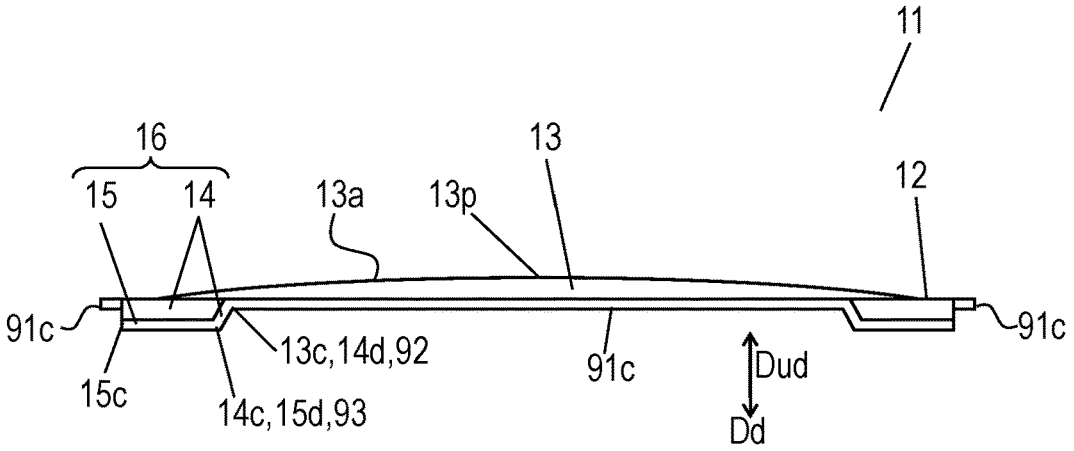
FIG. 2 is a side view of the movable contact according to the embodiment.
Figure 3:
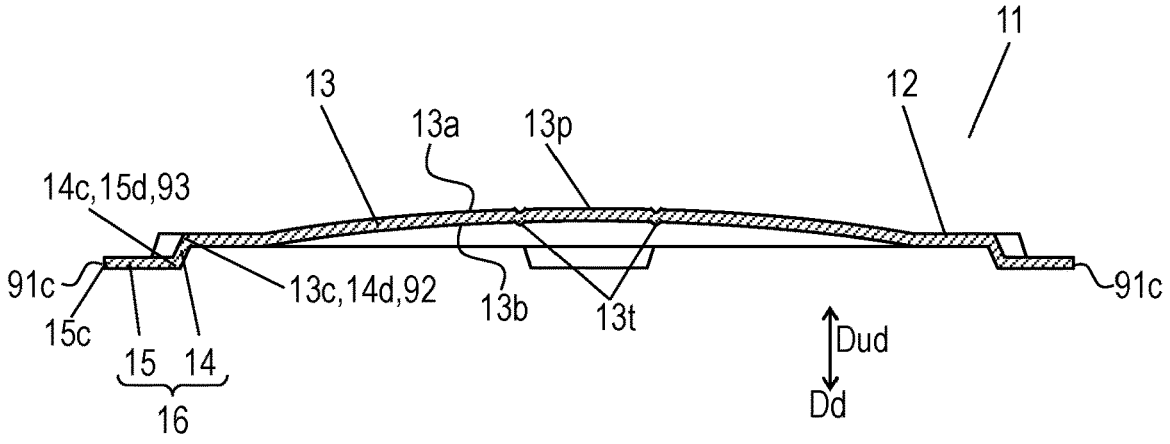
FIG. 3 is a cross-sectional view of the movable contact along line 3-3 shown in FIG. 1.
Figure 4:
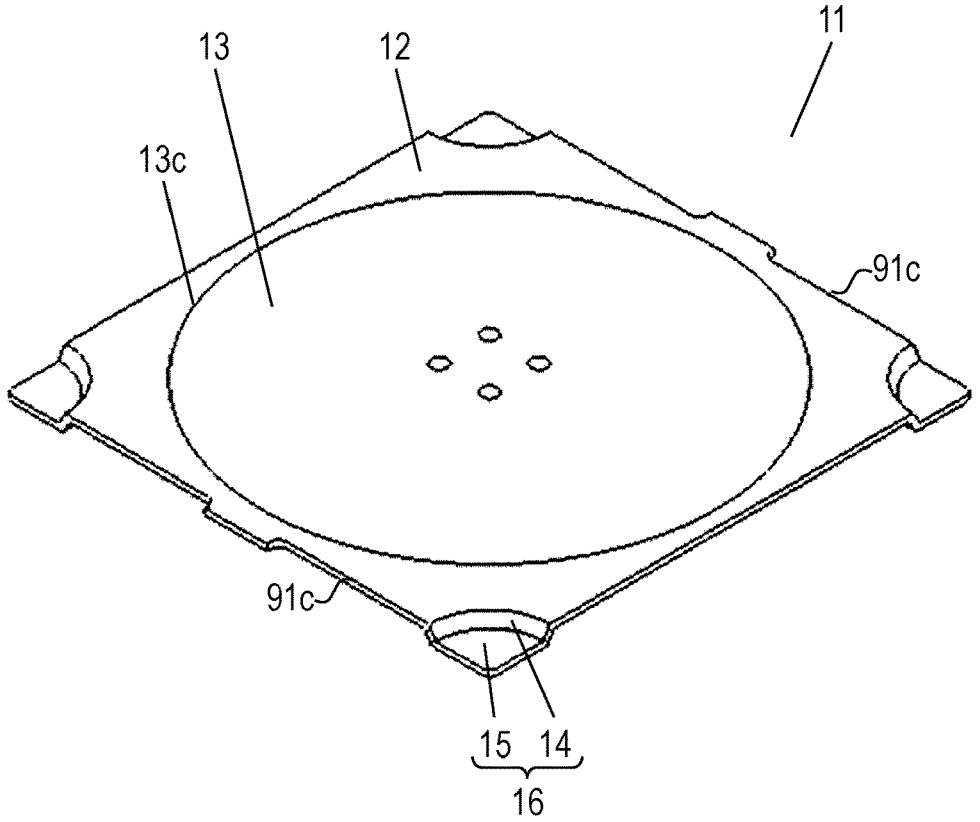
FIG. 4 is a perspective view of the movable contact according to the embodiment.

FIG. 1 is a top view of movable contact 11 according to an exemplary embodiment. FIG. 2 is a side view of movable contact 11. FIG. 3 is a cross-sectional view of movable contact 11 along line 3-3 illustrated in FIG. 1. FIG. 4 is a perspective view of movable contact 11.

Movable contact 11 includes conductive member 91 including flange 12, dome portion 13, contact portions 15, and drawn portions 16. Conductive member 91 is a metal plate. Each drawn portion 16 includes connection portion 14. Dome portion 13 is provided at the center of flange 12. Dome portion 13 has upper surface 13*a* which is convex upward, lower surface 13*b* which is concave upward and opposite to upper surface 13*a*, and outer border 13*c*. Flange 12 has inner border 12*d* connected to outer border 13*c* of dome portion 13, and extends from inner border 12*d*, i.e., outer border 13*c* of dome portion 13 to outer border 12*c* of flange 12 perpendicularly to upward and downward directions Dud away from dome portion 13. Dome portion 13 bulges from inner border 12*d* of flange 12 to the upper surface. Connection portion 14 protrudes downward from outer border 12*c* of flange 12. Conductive member 91 of movable contact 11 has substantially a rectangular shape when viewed from above the conductive member. Connection portion 14 and contact portion 15 are provided at each of four corners of the rectangular shape of conductive member 91. Upper border 14*d* of connection portion 14 is connected to outer border 12*c* of flange 12 at each of the four corners of the rectangular shape of conductive member 91. Connection portion 14 extends from upper border 14*d* to lower border 14*c* of connection portion 14. Contact portion 15 has outer border 15*c* and inner border 15*d* which is connected to lower border 14*c* of connection portion 14, and extends from inner border 15*d* to outer border 15*c* in direction Dh away from dome portion 13. Contact portion 15 faces a surface on which flange 12 is extended to outer end 91*c* of conductive member 91. Outer end 91*c* of conductive member 91 of movable contact 11 has outer borders 12*c* which are four sides of flange 12 and outer sides of connection portions 14 and contact portions 15. Then, in the above-described configuration, drawn portion 16 includes boundary portion 92 where connection portion 14 is connected to flange 12, connection portion 14, and boundary portion 93 where connection portion 14 is connected to contact portion 15 are connected. Connection portion 14 and contact portion 15 are formed by drawing flange 12.

Figure 5:
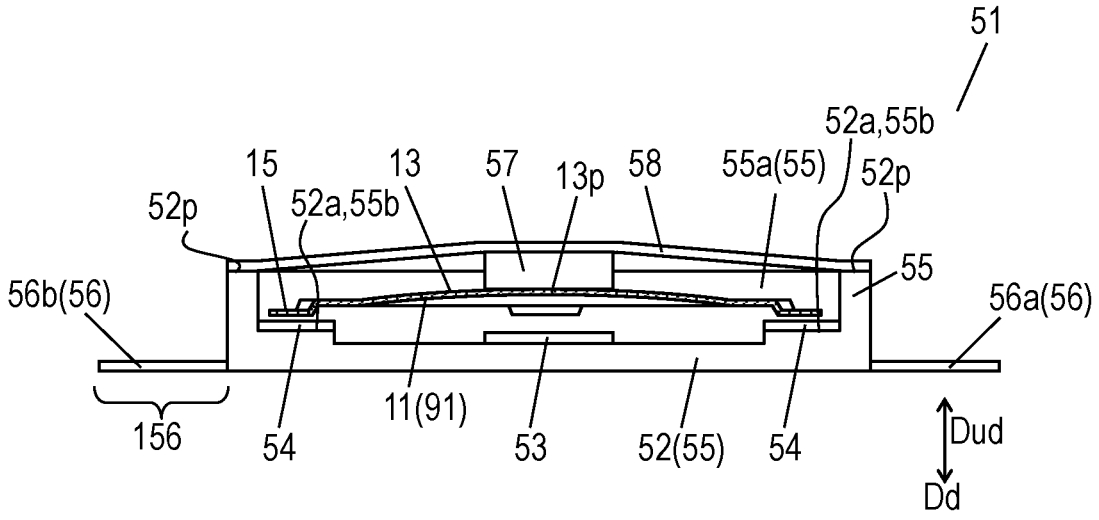
FIG. 5 is a schematic view of a switch according to the embodiment.

Switch 51 including movable contact 11 will be described below. FIG. 5 is a schematic view of switch 51. Switch 51 includes base 52 and fixed contacts 53 and 54. Fixed contacts 53 and 54 are formed on upper surface 52*a* of base 52. Movable contact 11 is mounted on base 52. Fixed contact 54 is disposed at a position facing contact portion 15, and contacts contact portion 15. Fixed contact 53 is disposed in downward direction Dd from apex 13*p* of dome portion 13 protruding upward to be spaced from dome portion 13. That is, in a normal state in which switch 51 is not activated, dome portion 13 does not contact fixed contact 53, so that switch 51 is in a normal off state, that is, is normally turned off.

When switch 51 is turned on, dome portion 13 is pushed down so that dome portion 13 contacts fixed contact 53. Upon the pushing of dome portion 13 down, the convex shape of dome portion 13 is buckled and inverted, and apex 13*p* of dome portion 13 contacts fixed contact 53, thereby electrically connecting fixed contacts 53 and 54 to each other via movable contact 11. Then, in this case, the inverting deformation of dome portion 13 generates a click feeling, and causes switch 51 to be turned on.

In the above configuration, in movable contact 11, since boundary portion 92 between connection portion 14 and flange 12, connection portion 14, and boundary portion 93 between connection portion 14 and contact portion 15 are formed by drawn portion 16, the strength of boundary portion 92 between connection portion 14 and flange 12 can be increased. Therefore, when dome portion 13 is pushed, contact between an outer border of dome portion 13 and upper surface 52*a* of base 52 can be suppressed before dome portion 13 is inverted. As a result, movable contact 11 can obtain a good clicking feeling. Further, in movable contact 11, boundary portion 92 between connection portion 14 and flange 12, connection portion 14, and boundary portion 93 between connection portion 14 and contact portion 15 constitute drawn portion 16. This configuration allows the height of connection portion 14, that is, a distance between outer border 12*c* of flange 12 and inner border 15*d* of contact portion 15 to be easily adjusted. Therefore, this configuration allows an operation stroke of movable contact 11 to be easily adjusted, and enhances accuracy of the height of connection portion 14. That is, although contact portion 15 is arranged at only four corners of movable contact 11, a gap between contact portion 15 and fixed contact 54 is hardly produced while movable contact 11 is mounted onto upper surface 52*a* of base 52. This configuration suppresses wobbling of movable contact 11.

In the conventional movable contact disclosed in PTL 1, a contact portion is formed by bending from a flange. In this case, a stress is concentrated on a bent portion between the flange and the contact portion due to a force pushing a dome portion. Therefore, when the dome portion is pushed, an outer border of the dome portion may contact a bottom portion of a board or a base before the dome portion is inverted, thereby preventing a desired clicking feeling.

Movable contact 11 according to the embodiment provides a preferable clicking feeling, as described above.

Switch 51 will be detailed below. Switch 51 further includes terminal block 55, terminal 56, push plate 57, and protective sheet 58. Recess portion 55*a* is provided in the center of terminal block 55. Base 52 constitutes a part of terminal block 55. In detail, base 52 is provided on bottom surface 55*b* of recess portion 55*a*. That is, upper surface 52*a* of base 52 constitutes bottom surface 55*b* of recess portion 55*a*. Fixed contacts 53 and 54 are exposed on bottom surface 55*b* of recess portion 55*a*. Fixed contact 53 is disposed at the center of recess portion 55*a*. Terminal 56 is insert-molded on terminal block 55 except for soldered portion 156. Terminal 56 includes terminals 56*a* and 56*b*. Terminal 56*a* is electrically connected to fixed contact 53. Terminal 56*b* is electrically connected to fixed contact 54.

Movable contact 11 is accommodated in recess portion 55*a* such that contact portion 15 faces fixed contact 54. Protective sheet 58 covers recess portion 55*a* of terminal block 55. Protective sheet 58 is welded to upper end portion 52*p* of base 52 near recess portion 55*a*. Push plate 57 is provided between apex 13*p* of dome portion 13 and protective sheet 58. Push plate 57 is preferably welded to protective sheet 58.

Movable contact 11 will be detailed below. Movable contact 11 (conductive member 91) has a square shape when viewed from above the conductive member. Outer border 13*c* of dome portion 13 preferably has a circular shape when viewed from above the conductive member. A cross section of dome portion 13 passing through apex 13*p* of dome portion 13 preferably has substantially an arcuate shape. That is, dome portion 13 preferably has a shape along a spherical shape. This configuration allows a force to be applied evenly to four contact portions 15 when dome portion 13 is pushed down. Movable contact 11 preferably has protrusions 13*t* protruding downward from lower surface 13*b* at a top of dome portion 13 around apex 13*p* (see FIG. 3). That is, while movable contact 11 is mounted on base 52, protrusions 13*t* protrude toward fixed contact 53. Although the number of protrusions 13*t* is, for example, four, the present invention is not limited to this configuration, and the number of protrusions 13*t* may be one, three, or five or more. Movable contact 11 may not necessarily have protrusion 13*t*. Movable contact 11 may not necessarily have protrusion 13*t* and may have a hole penetrating dome portion 13 at the top of dome portion 13.

Drawn portion 16 is curved to be concave toward dome portion 13 when viewed from above the conductive member. In other words, drawn portion 16 is curved to be concave toward dome portion 13 when viewed from above the conductive member. That is, connection portion 14 is curved to be concave toward dome portion 13 when viewed from above the conductive member. That is, boundary portions 92 and 93 are curved to be concave toward dome portion 13 when viewed from the upper surface of the connection portion. This configuration increases the strength of boundary portion 92 between flange 12 and connection portion 14. Drawn portion 16 preferably has an arcuate shape when viewed from above the conductive member. The radius of the arcuate shape of drawn portion 16 is smaller than the radius of the circular shape of dome portion 13 when viewed from above the conductive member. This configuration increases the strength of boundary portion 92 between flange 12 and connection portion 14, and reduces a stress concentrated on boundary portion 92 between flange 12 and connection portion 14. Therefore, a preferable clicking feeling is obtained even when the force pushing dome portion 13 down is large. Further, even when dome portion 13 is repetitively pushed down, deformation of boundary portion 92 between flange 12 and connection portion 14 can be reduced. Therefore, even when dome portion 13 is repetitively pushed, a preferable clicking feeling can be obtained. Further, occurrence of a decrease in a stroke of movable contact 11 can be suppressed.

Contact portion 15 is connected to lower border 14*c* of connection portion 14. Center 16*s* of the arcuate shape of drawn portion 16 is positioned at intersection point P1 (see FIG. 1) between extension lines of adjacent sides of flange 12 when viewed from above the conductive member. This configuration allows contact portion 15 to have a large size, and increases the length of contact portion 15 extending from flange 12. Center 16*s* of the arcuate shape of drawn portion 16 may be positioned outside intersection point P1, that is, farther from dome portion 13 than intersection point P1.

When viewed from above the conductive member center 13*s* of dome portion 13 is preferably located on a straight line passing through centers 16*s* of two drawn portions 16 located in a diagonal direction. This configuration allows a force to be applied evenly to four contact portions 15 when dome portion 13 is pushed down.

When movable contact 11 is mounted on base 52, contact portion 15 is preferably parallel to fixed contact 54. In this case, contact portion 15 extends from connection portion 14 in a horizontal direction. When movable contact 11 is mounted on base 52, this configuration allows movable contact 11 to stably contact the base, Upon dome portion 13 being pushed down, contact portion 15 moves outward accordingly. At this moment, contact portion 15 slides on fixed contact 54. Contact portion 15 may be inclined in a direction away from fixed contact 54, that is, in an upward direction toward outer border 15*c* of contact portion 15 from boundary portion 93 between connection portion 14 and contact portion 15. This configuration suppresses abrasion and scraping of contact portion 15 or fixed contact 54, accordingly improving the life time of switch 51. In particular, in the case that a conductor pattern of the printed circuit board is used as fixed contact 54, the conductor pattern is prevented from damage.

In switch 51, movable contact 11 is accommodated in base 52. However, the present invention is not limited to this configuration. Movable contact 11 may be attached to an adhesive film to form a tactile switch.

(Modification)

Figure 6:
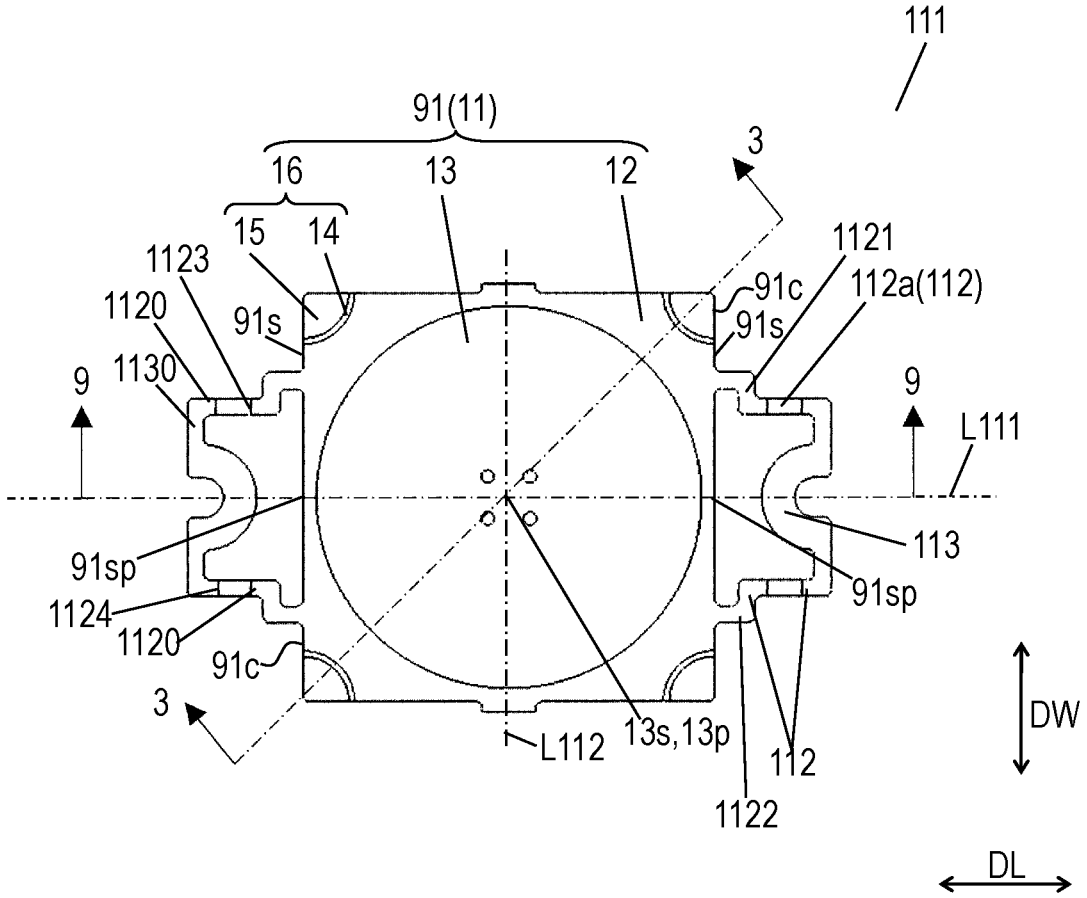
FIG. 6 is a top view of another movable contact according to the embodiment.
Figure 7:
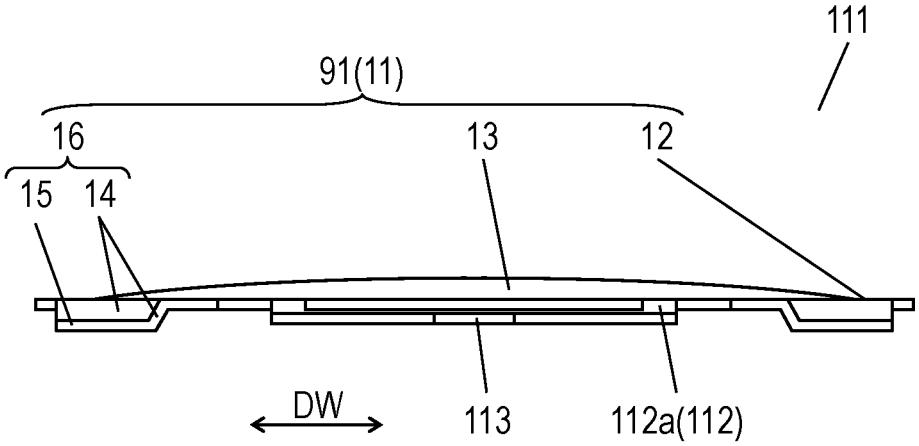
FIG. 7 is a side view of the movable contact illustrated in FIG. 6.
Figure 8:
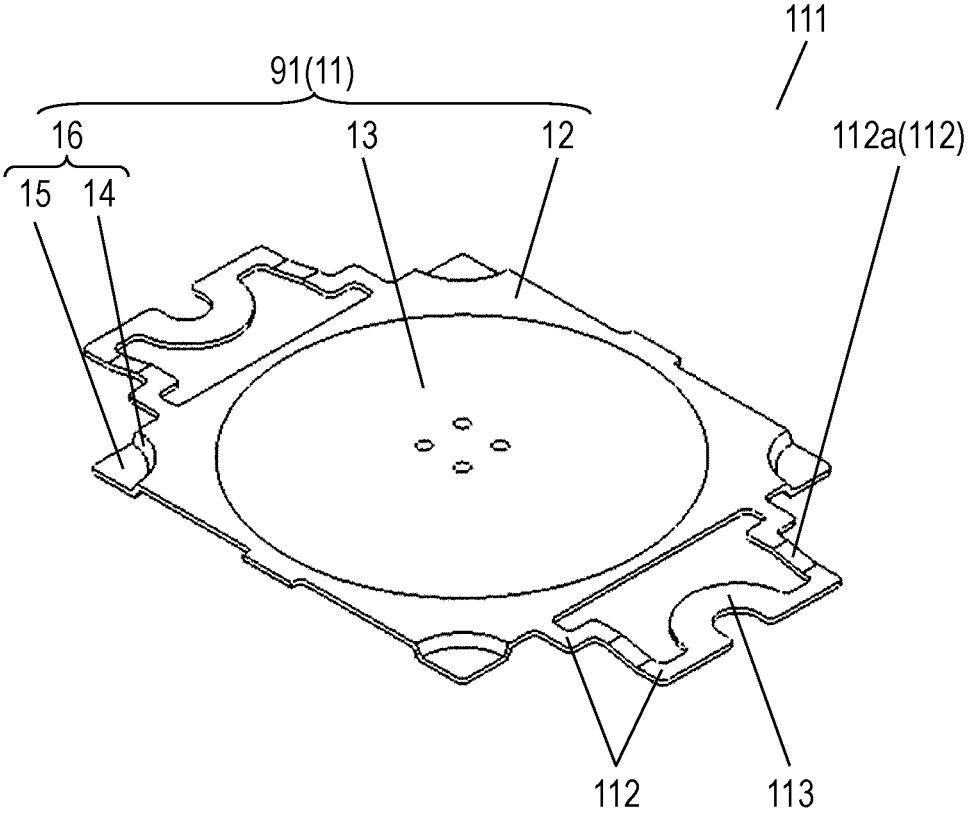
FIG. 8 is a perspective view of the movable contact illustrated in FIG. 6.
Figure 9:
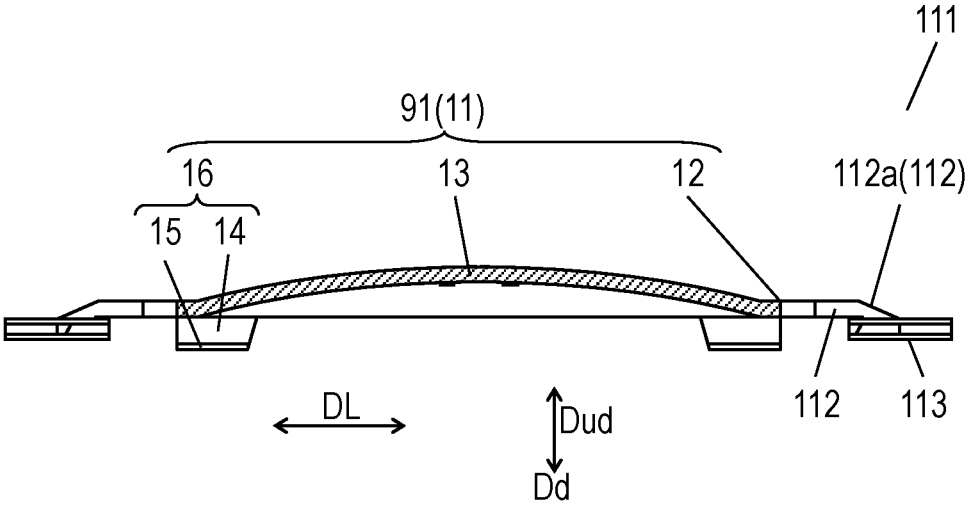
FIG. 9 is a cross-sectional view of the movable contact illustrated in FIG. 6.

FIG. 6 is a top view of another movable contact 111 according to the embodiment. FIGS. 7 and 8 are a side view and a perspective view of movable contact 111, respectively. FIG. 9 is a cross-sectional view of movable contact 111 along line 9-9 illustrated in FIG. 6. In FIGS. 6 to 9, components identical to those of movable contact 11 illustrated in FIGS. 1 to 4 are denoted by the same reference numerals. Movable contact 111 further includes two extension portions 112 and 1120 and two mounting portions 113 and 1130 in addition to movable contact 11. Two extension portions 112 and 1120 protrude in directions away from each other from rectangular sides 91*s* of conductive member 91

(flange 12) on opposite sides. Mounting portions 113 and 1130 are provided in tip ends of extension portions 112 and 1120, respectively. When mounting portion 113 is reflow-soldered, this configuration suppresses the Manhattan phenomenon due to a surface tension of the soldered part. Two extension portions 112 and 1120 protrude in directions away from each other from opposite sides 91*s* of conductive member 91 in longitudinal direction DL perpendicular to upward and downward directions Dud. Extension portions 112 and 1120 do not protrude from conductive member 91 in widthwise direction DW perpendicular to upward and downward directions Dud and longitudinal direction DL. Extension portion 112 includes plural extension sections 1121 and 1122 extending from dome portion 13 and connected to mounting portion 113. Extension portion 1120 includes plural extension sections 1123 and 1124 extending from dome portion 13 and connected to mounting portion 1130. The number of the extension sections of extension portion 112 may be three or more or may be one. Similarly, the number of the extension sections of extension portion 1120 may be three or more or may be one.

Figure 10:
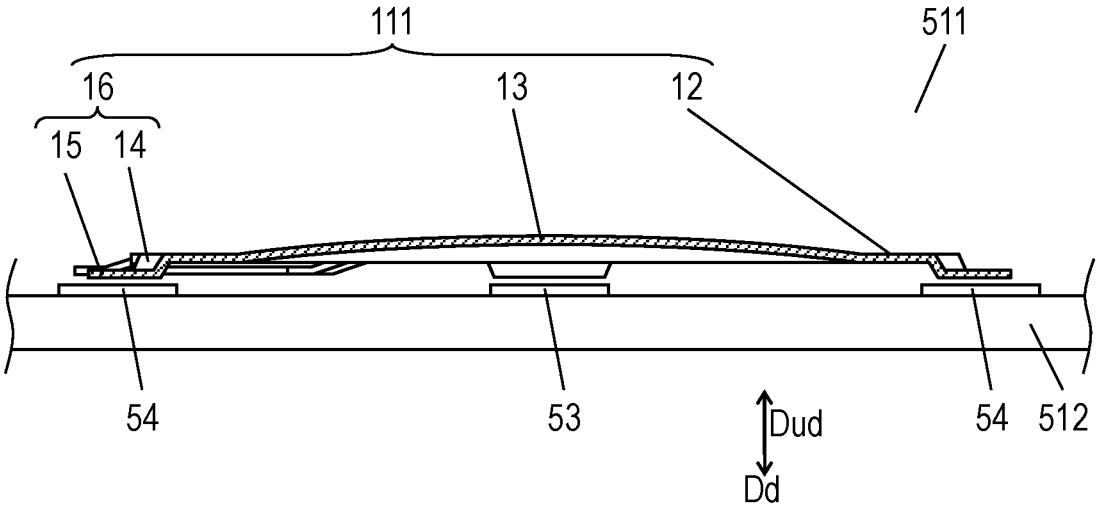
FIG. 10 is a cross-sectional view of another switch according to the embodiment.
Figure 11:
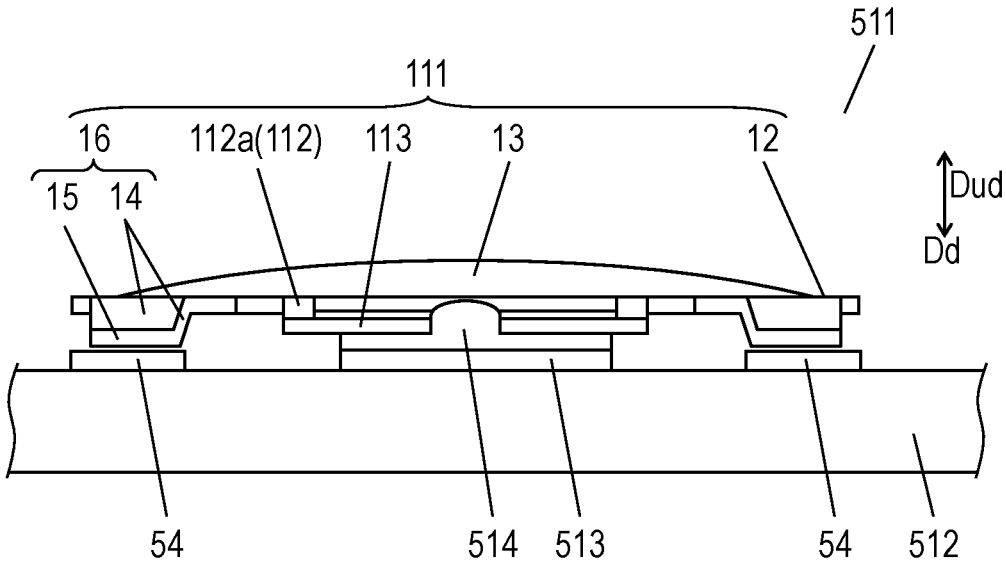
FIG. 11 is an external view of the switch illustrated in FIG. 10.
Figure 12:
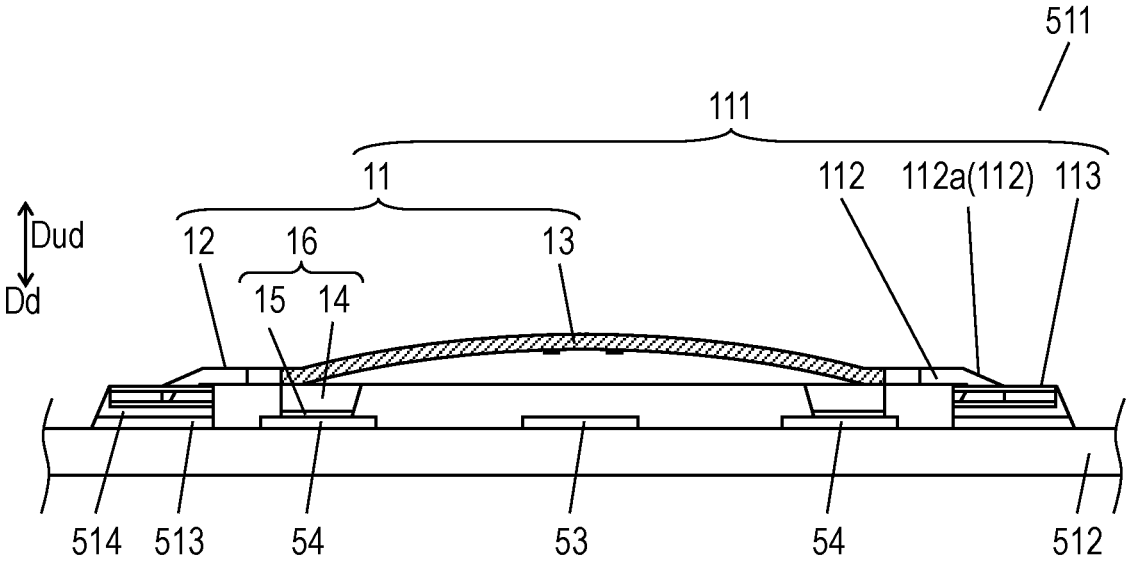
FIG. 12 is a cross-sectional view of the switch illustrated in FIG. 10.

FIG. 10 is a cross-sectional view of another switch 511 according to the embodiment. FIGS. 11 and 12 are an external view and a cross-sectional view of switch 511, respectively. Switch 511 includes movable contact 111 and base 512. In accordance with the embodiment, base 512 is a wiring board. Fixed contacts 53 and 54 and mounting conductor 513 are formed on an upper surface of base 512. Movable contact 111 is mounted on the upper surface of base 512. In this configuration, mounting conductor 513 faces mounting portion 113. Mounting conductor 513 is connected to mounting portion 113 with connection agent 514. For example, soldering or the like can be used as connection agent 514. This configuration allows movable contact 111 to be mounted on and fixed to base 512. In this fixed state of movable contact 111, each contact portion 15 contacts corresponding fixed contact 54 with a predetermined pressure applied to the fixed contact.

That is, since connection agent 514 is provided between mounting conductor 513 and mounting portion 113, contact portion 15 is preferably located below mounting portion 113. This configuration prevents connection agent 514 from being pushed by mounting portion 113 and protruding from mounting conductor 513. In the case that soldering is used as connection agent 514, this configuration suppresses occurrence of solder balls at locations other than mounting conductor 513. Since contact portion 15 is located below mounting portion 113, movable contact 111 is mounted on base 512 stably at four contact portions 15. Therefore, instead of a configuration in which two mounting portions 113 extend from two opposite sides 91*s* of flange 12, two mounting portions 113 may extend from one side 91*s* of flange 12. In this case, the number of mounting portions 113 is not limited to two and may be one.

Extension portion 112 preferably includes bent portion 112*a* provided between flange 12 and mounting portion 113. Bent portion 112*a* is diagonally inclined downward when viewed from a side. This configuration reduces stress concentration on extension portion 112 during pressing, and suppresses occurrence of cracks and the like in extension portion 112. Extension portion 112 preferably has a crank shape between flange 12 and mounting portion 113 when viewed from above the conductive member. When viewed from above the conductive member. the crank shape is preferably provided between flange 12 and bent portion 112*a* or between bent portion 112*a* and mounting portion 113. This configuration increases a creeping distance from mounting portion 113 to contact portion 15, and prevents a flux contained in the soldering from invading contact portion 15. Further, since a flowing direction in which the flux flows can be changed, a risk that the flux, which is an insulator, invades contact portion 15 and the like can be further reduced.

Figure 13:
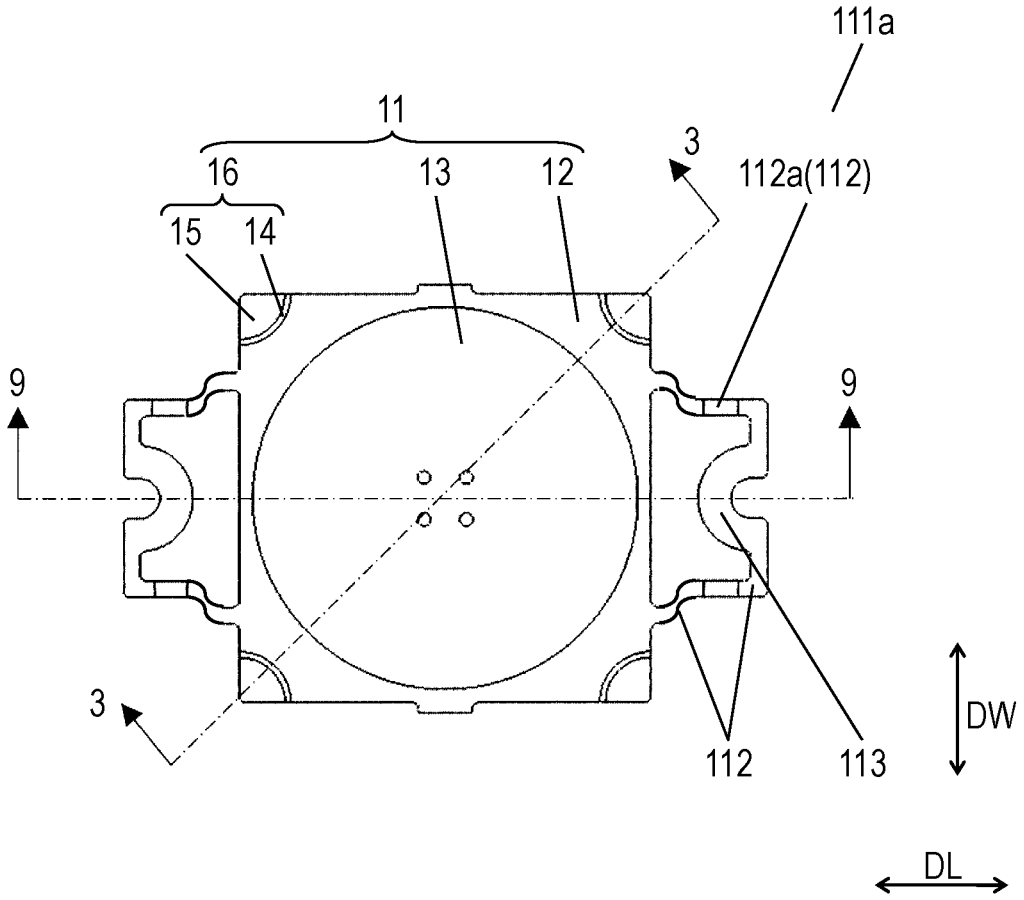
FIG. 13 is a top view of still another movable contact according to the embodiment.

FIG. 13 is a top view of still another movable contact 111*a* according to the embodiment. In FIG. 13, components identical to those of movable contact 111 illustrated in FIG. 6 are denoted by the same reference numerals. In movable contact 111*a*, extension portion 112 is bent not in a crank shape but in an S shape. Movable contact 111*a* provides the same effect as movable contact 111.

In movable contact 111 (111*a*), as illustrated in FIG. 6, extension portion 112 is preferably symmetrical with respect to center line L111 which passes through middle point 91*sp* of side 91*s* of flange 12 and which is perpendicular to side 91*s*. Mounting portion 113 is preferably symmetrical with respect to center line L111. This configuration prevents movable contact 111 mounted on base 512 from inclining. Extension sections 1121 and 1122 of extension portion 112 are symmetrical to each other with respect to center line L111. Extension sections 1123 and 1124 of extension portion 1120 are symmetrical to each other with respect to center line L111.

In movable contact 111 (111*a*), as illustrated in FIG. 6, extension portions 112 and 1120 are preferably symmetrical to each other with respect to center line L112 which pass through center 13*s* of dome portion 13 and which is perpendicular to upward and downward directions Dud and center line L111. Mounting portion 1130 is preferably symmetrical with respect to center line L112. This configuration prevents movable contact 111 mounted on base 512 from inclining. Extension section 1121 of extension portion 112 and extension section 1123 of extension portion 1120 are symmetrical to each other with respect to center line L112. Extension section 1122 of extension portion 112 and extension section 1124 of extension portion 1120 are symmetrical to each other with respect to center line L112.

Figure 14:
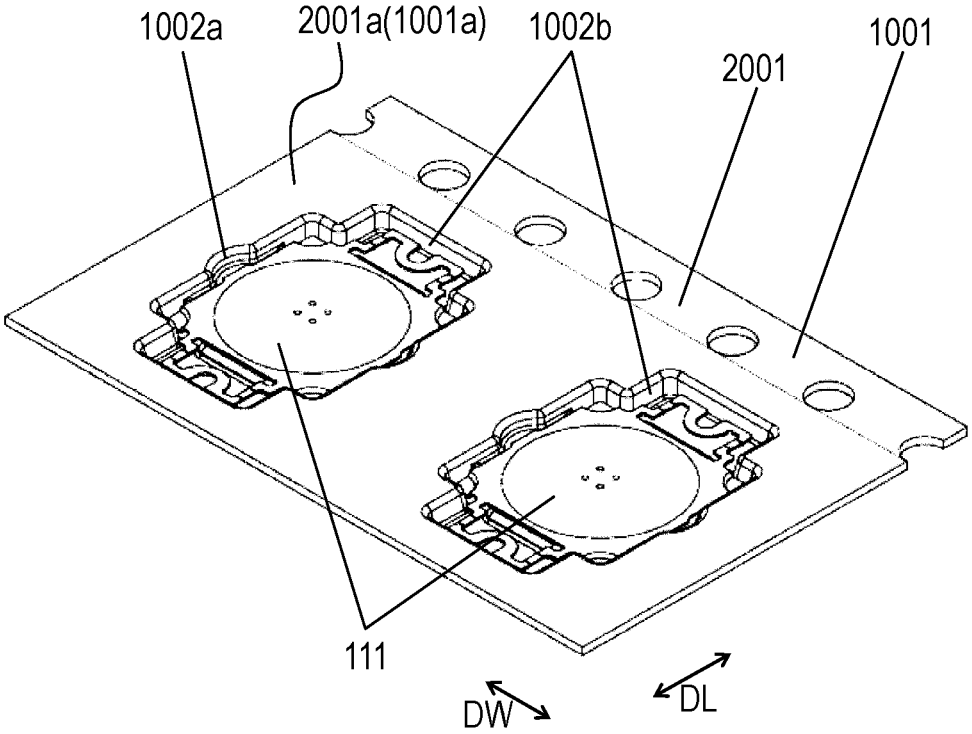
FIG. 14 is a perspective view of an embossed tape that accommodates the movable contact according to the embodiment.
Figure 15:
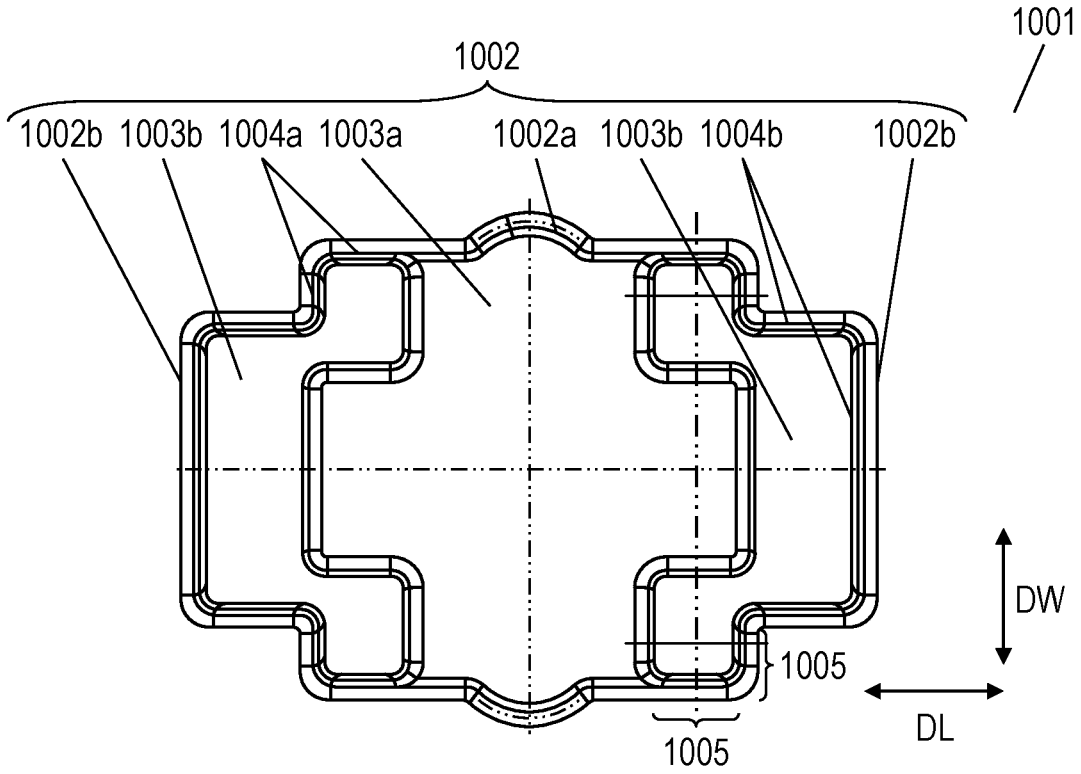
FIG. 15 is a top view of the embossed tape according to the embodiment.
Figure 16:
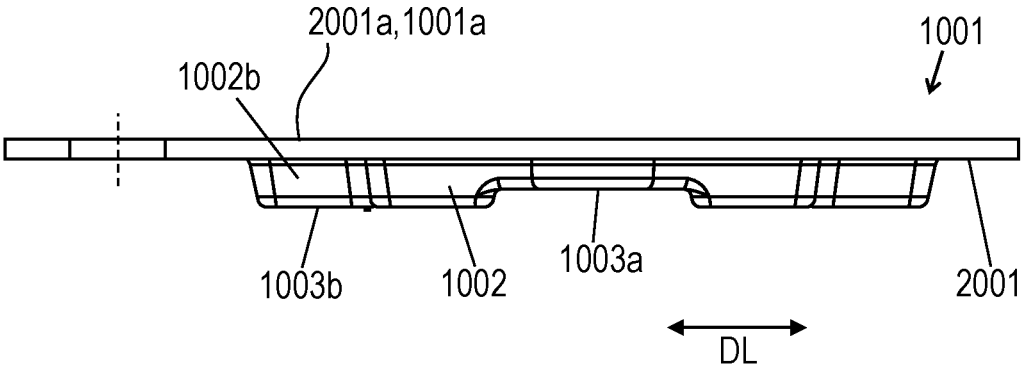
FIG. 16 is a side view of the embossed tape according to the embodiment.

FIG. 14 is a perspective view of embossed tape 1001 accommodating movable contact 111 therein according to the embodiment. FIGS. 15 and 16 are a top view and a side view of embossed tape 1001, respectively.

Embossed tape 1001 includes base tape 2001 having upper surface 2001*a* having accommodation recess portion 1002 therein. Accommodation recess portion 1002 configured to accommodate movable contact 111 therein. Accommodation recess portion 1002 includes recess portion 1002*a*, recess portion 1002*b*, and regulator portion 1005. Recess portion 1002*a* is connected to recess portion 1002*b*. Recess portions 1002*a* and 1002*b* constitute accommodation recess portion 1002. Recess portion 1002*a* includes receiving portion 1003*a* and side wall 1004*a*. Recess portion 1002*b* has bottom surface 1003*b* and side wall 1004*b*. Receiving portion 1003*a* is provided on the bottom surface of recess portion 1002*a*.

An interval between two outer sides of extension portion 112 connected to one side 91*s* of flange 12 (conductive member 91) is smaller than the width of flange 12 of movable contact 111. Therefore, the width of recess portion 1002*b* is smaller than the width of recess portion 1002*a*. Flange 12 of movable contact 111 is accommodated in recess portion 1002*a*. Receiving portion 1003*a* receives the lower surface of flange 12 of movable contact 111 thereon. Extension portion 112 and mounting portion 113 of movable contact 111 are accommodated in recess portion 1002*b*.

Extension portion 112 includes bent portion 112*a* provided between flange 12 and mounting portion 113. Extension portion 112 is bent between flange 12 and bent portion 112*a* in a crank shape or an S shape when viewed from above the conductive member. This configuration allows extension portion 112 to be ling. The width of extension portion 112 is small so as to flexibly deform according to deformation of movable contact 111 due to pressing, thereby dispersing stress concentration.

Extension portion 112 is long and thin, and deforms even with a small force. Regulator portion 1005 is formed in a part of side wall 1004*a* of recess portion 1002*a*. Regulator portion 1005 regulates respective positions of the outer periphery of contact portion 15 of movable contact 111, the outer periphery of connection portion 14, and a part of the outer periphery of flange 12. That is, regulator portions 1005 are provided at four corners of recess portion 1002*a* corresponding to four corners of conductive member 91 of movable contact 111, respectively. This configuration the four corners of flange 12 to regulate the position of movable contact 111. Regulator portion 1005 does not necessarily regulate the positions of the outer periphery of contact portion 15, the outer periphery of connection portion 14, and a part of the outer periphery of flange 12, and may regulate at least the position of a part of the outer periphery of contact portion 15.

A gap between the outer periphery of contact portion 15 and regulator portion 1005 in widthwise direction DW is smaller than a gap between extension portion 112 and side wall 1004*b* of recess portion 1002*b* in widthwise direction DW. A gap between the outer periphery of contact portion 15 and regulator portion 1005 in longitudinal direction DL is smaller than a gap between mounting portion 113 and side wall 1004*b* of recess portion 1002*b* in longitudinal direction DL.

This configuration prevents extension portion 112 and mounting portion 113 from contacting side wall 1004*b* of recess portion 1002*b*, and suppresses deformation of extension portion 112 and mounting portion 113. Therefore, a contact between movable contact 111 and fixed contact 54 in switch 511 can be prevented from damage.

In particular, regulator portion 1005 regulates the position of movable contact 111 at drawn portion 16. Drawn portion 16 is formed by drawing. Drawn portion 16 is curved to be concave toward dome portion 13 (inward). Therefore, drawn portion 16 has a large strength and precision. Since drawn portion 16 having such a large strength precision is regulated, movable contact 111 can be regulated accurately and accommodated in embossed tape 1001. Therefore, movable contact 111 can be accurately mounted on wiring board 512.

The conventional movable contact disclosed in PTL 2 has a protrusion portion protruding outward from the dome portion. The position of the movable contact in the embossed tape is regulated together with the protrusion portion itself. In this configuration, the protrusion portion may deform. The deformation of the protrusion may reduce stability of the contact between the movable contact and the fixed contact.

As described above, in accordance with the embodiment, movable contact 111 (111*a*) accommodated in embossed tape 1001 prevents extension portion 112 and mounting portion 113 from deforming, accordingly preventing the contact between movable contact 111 (111*a*) and fixed contact 54 in switch 511 from damage.

Embossed tape 1001 will be detailed below. When viewed from a side surface of embossed tape 1001, bottom surface 1003*b* of recess portion 1002*b* protrudes from receiving portion 1003*a*, as illustrated in FIG. 16. That is, recess portion 1002*b* is recessed from receiving portion 1003*a* that constitutes the bottom surface of recess portion 1002*a*. Therefore, while movable contact 111 is accommodated in accommodation recess portion 1002, a gap can be formed between mounting portion 113 and bottom surface 1003*b*. As a result, mounting portion 113 is prevented from contacting bottom surface 1003*b*, accordingly preventing the deformation of mounting portion 113 and extension portion 112.

Movable contact 111 includes two mounting portions 113 and 1130. Therefore, accommodation recess portion 1002 includes two recess portions 1002*b*. Mounting portions 113 and 1130 are connected to each other via extension portions 112 and 1120 extending from two opposite sides 91*s* of flange 12, respectively. Thus, recess portions 1002*b* are disposed on both sides of recess portion 1002*a* in longitudinal direction DL.

Recess portion 1002*b* extends to a position facing contact portion 15. In movable contact 111, in height direction Dud, a distance from flange 12 to contact portion 15 is larger than a distance from flange 12 to mounting portion 113. Then, a gap is provided between bottom surface 1003*b* of recess portion 1002*b* and a lower surface of contact portion 15 serving as a mounting surface of contact portion 15. This configuration increases the gap between mounting portion 113 and bottom surface 1003*b*. Therefore, mounting portion 113 is prevented from contacting bottom surface 1003*b*, accordingly preventing the deformation of mounting portion 113 and extension portion 112.

Accommodation recess portion 1002 has a region where recess portion 1002*a* overlaps recess portion 1002*b*. In side wall 1004*a*, regulator portion 1005 is formed in the region where recess portion 1002*a* overlaps recess portion 1002*b*.

Mounting portion 113 does not necessarily have a configuration in which mounting portion 113 extends from two opposite sides of flange 12, and may have a configuration in which mounting portion 113 extends from one side of flange 12. Alternatively, the number of mounting portions 113 is not limited to two, but may be one. Contact portion 15 protrudes downward from mounting portion 113. Thus, regardless of the number or the arrangement of mounting portions 113, four contact portions 15 contact base 512, which is a wiring board, and maintains the posture of movable contact 111. In this case, accommodation recess portion 1002 has one recess portion 1002*a* and one recess portion 1002*b*. Recess portion 1002*b* is disposed only on one side of recess portion 1002*a* in longitudinal direction DL.

Figure 17:
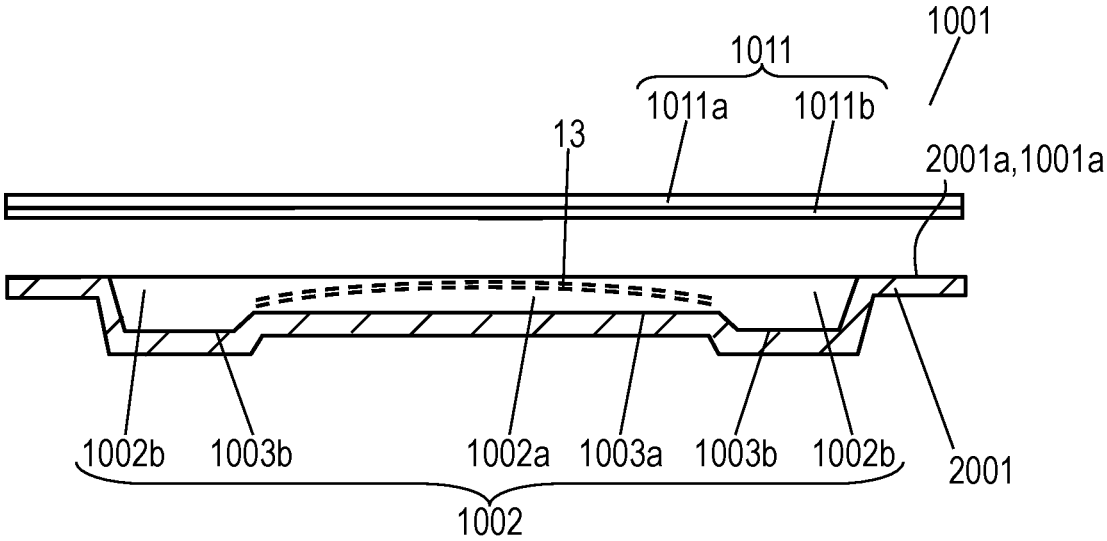
FIG. 17 is a cross-sectional view of the embossed tape according to the embodiment.

FIG. 17 is a cross-sectional view of embossed tape 1001 including sealing film 1011. Embossed tape 1001 includes sealing film 1011. Embossed tape 1001 has upper surface 1001*a* constituted by upper surface 2001*a* of base tape 2001. Accommodation recess portion 1002 is recessed from upper surface 2001*a* of base tape 2001. Sealing film 1011 includes base 1011*a* and adhesive layer 1011*b*. Sealing film 1011 includes adhesive layer 1011*b* provided on one surface of base 1011*a*. Then, adhering sealing film 1011 adheres to upper surface 2001*a* with adhesive layer 1011*b*, and causes sealing film 1011 to cover accommodation recess portion 1002.

Figure 18:
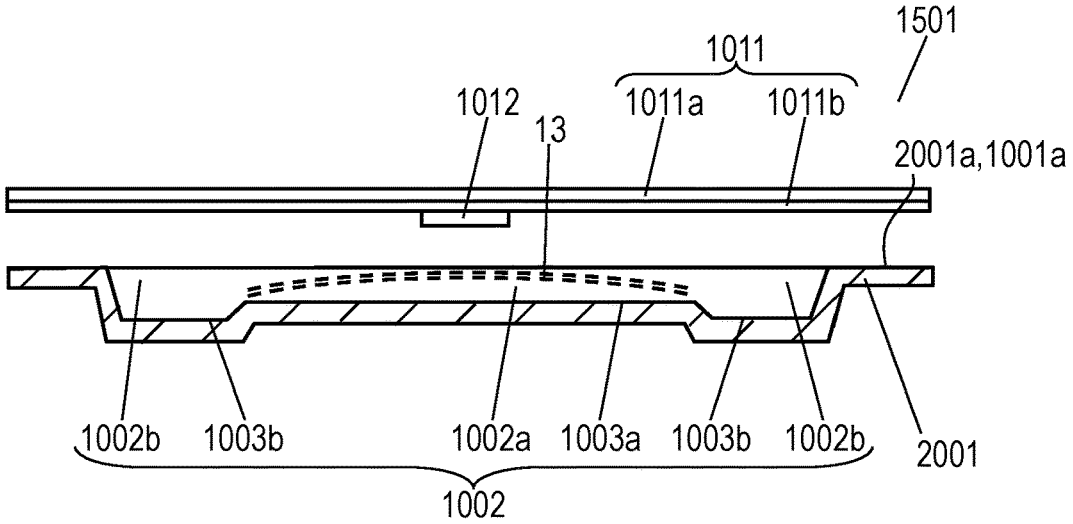
FIG. 18 is a cross-sectional view of another embossed tape according to the embodiment.

FIG. 18 is a cross-sectional view of another embossed tape 1501 including sealing film 1011 according to the embodiment. In FIG. 18, components identical to those of embossed tape 1001 illustrated in FIG. 17 are denoted by the same reference numerals. In embossed tape 1501 illustrated in FIG. 18, regulator body 1012 is disposed on sealing film 1011. Regulator body 1012 is coupled to sealing film 1011.

Regulator body 1012 limits displacement of movable contact 111 in upward and downward directions Dud. In detail, although regulator body 1012 allows a certain range of displacement of movable contact 111 in upward and downward directions Dud, regulator body 1012 determines an upper limit of the range of the displacement, that is, the amount of the displacement. Alternatively, regulator body 1012 prevents movable contact 111 from being displaced in upward and downward directions Dud. Regulator body 1012 is preferably disposed between sealing film 1011 and apex 13*p* of dome portion 13 of movable contact 111. Regulator body 1012 may contact dome portion 13.

Figure 19:
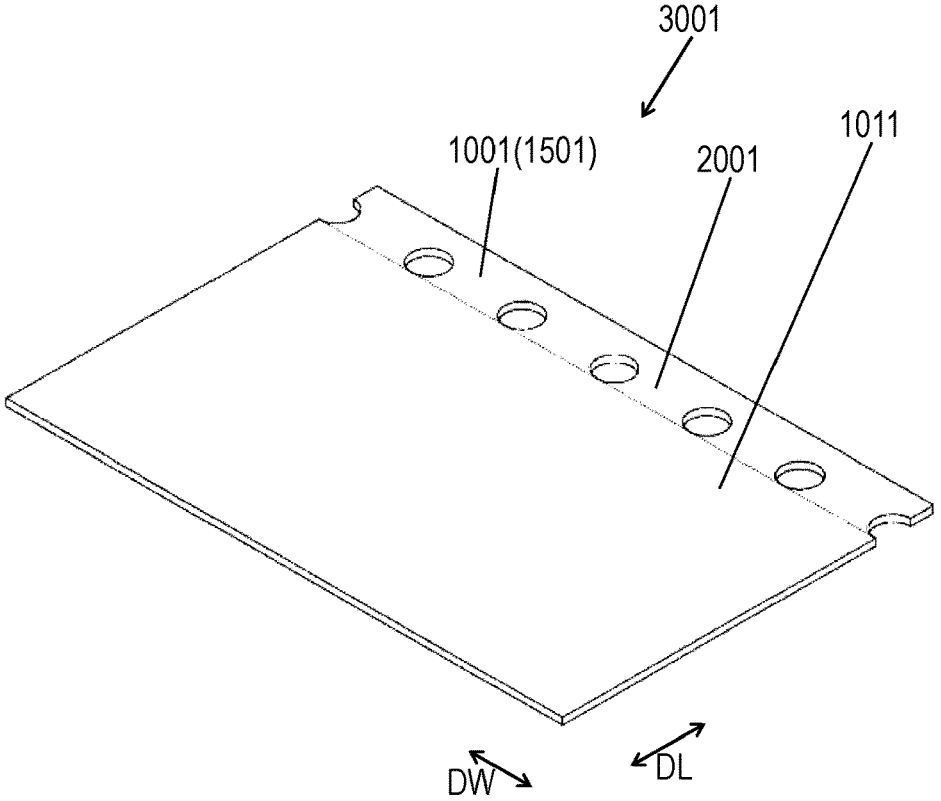
FIG. 19 is a perspective view of a component tape according to the embodiment.

FIG. 19 is a perspective view of component tape 3001 including embossed tape 1001 (1501) accommodating movable contact 111 therein and having sealing film 1011 attached thereon. When switch 511 is manufactured, sealing film 1011 is peeled off from upper surface 1001*a* of embossed tape 1001 (1501), that is, from upper surface 2001*a* of base tape 2001, and then, movable contact 111 is pulled out from accommodation recess portion 1002. The configuration of component tape 3001 allows movable contact 111 preventing extension portion 112 and mounting portion 113 from deforming to be taken out.

In embossed tape 1501 illustrated in FIG. 18 in which regulator body 1012 is disposed between dome portion 13 of movable contact 111 and sealing film 1011, regulator body 1012 prevents movable contact 111 from directly contacting the adhesive. This configuration prevents movable contact 111 from rubbing adhesive layer 1011*b* due to, e.g. vibration during transportation. Accordingly, adhesive layer 1011*b* from being peeled off and adhering to movable contact 111. This suppresses loss of contact between movable contact 111 and fixed contact 53 or 54.

As described above, the above-described embodiment has been described as an example of a technology in the present disclosure. However, the technology in the present disclosure is not limited to the above-described configurations, and can be applied to embodiments in which changes, substitutions, additions, omissions, and the like are made as appropriate. Further, it is also possible to combine components described in the embodiments to form a novel embodiment.

In the embodiment, terms indicating directions, such as "upper surface", "lower surface", "upper side", and "lower side", indicate relative directions determined only by a relative positional relationship of portions of the movable contact, and do not indicate absolute directions, such as a vertical direction.

REFERENCE MARKS IN THE DRAWINGS

11 movable contact
12 flange
13 dome portion
14 connection portion
15 contact portion
16 drawn portion
51 switch
52 base
53 fixed contact
54 fixed contact
55 terminal block
55*a* recess portion
56 terminal
56*a* terminal
56*b* terminal
57 push plate
58 protective sheet
111 movable contact
112 extension portion
112*a* bent portion
113 mounting portion
511 switch
512 base
513 mounting conductor
514 connection agent
1001 embossed tape
1002, 1002*a*, 1002*b* recess portion
1003*a* receiving portion
1003*b* bottom surface
1004*a*, 1004*b* side wall
1005 regulator portion
1011 sealing film
1011*a* base
1011*b* adhesive layer
1012 regulator body

The invention claimed is:

1. A movable contact comprising a conductive member having an outer end having substantially a rectangular shape when viewed from above the conductive member, wherein the conductive member includes:

a dome portion having an upper surface which is convex upward, a lower surface which is concave upward, and an outer border;

a flange having an outer border and an inner border which is connected to the outer border of the dome portion, the flange extending from the inner border of the flange to the outer border of the flange in a direction away from the dome portion when viewed from above the conductive member;

connection portions provided at four corners of the rectangular shape of the conductive member, respectively, each of the connection portions having a lower border and an upper border which is connected to the lower border of the flange, the each of the connection portions protruding from the upper border of the each of the connection portions downward to the lower border of the each of the connection portions; and contact portions, respective one of the contact portions having an outer border and an inner border which is connected to the lower border of the each of connection portions, the respective one of the contact portions extending from the inner border of the respective one of the contact portions away from the flange when viewed from above the conductive member, and the connection portion, a first boundary portion where the each of the connection portions is connected to the flange, and a second boundary portion where the each of the connection portions is connected to the respective one of the contact portions constitute a drawn portion.

2. The movable contact of claim 1, wherein the first boundary portion is curved to be concave toward the dome portion when viewed from above the conductive member, and the second boundary portion is curved to be concave toward the dome portion when viewed from above the conductive member.

3. The movable contact of claim 1, further comprising:

a first extension portion protruding from the conductive member; and a mounting portion connected to the first extension portion, wherein the outer end of the conductive member having the rectangular shape has a first side and a second side opposite to each other, and the first extension portion protrudes from the first side.

4. The movable contact of claim 3, further comprising a second extension portion protruding from the second side of the outer end of the conductive member in a direction away from the first extension portion.

5. The movable contact of claim 3, wherein the contact portion is located below the mounting portion.

6. The movable contact of claim 3, wherein the first extension portion has a bent portion that is bent.

7. The movable contact of claim 3, wherein the first extension portion is bent between the flange and the mounting portion in a crank shape or an S-shape when viewed from above the conductive member.

8. The movable contact of claim 3, wherein the first extension portion is symmetrical with respect to a center line passing through a middle point of the first side perpendicularly to the first side, and the mounting portion is symmetrical with respect to the center line.

9. A switch comprising:

the movable contact of claim 3;

a base;

a first fixed contact provided on an upper surface of the base and below the dome portion of the movable contact;

a second fixed contact provided on the upper surface of the base and facing the contact portion of the movable contact;

a mounting conductor facing the mounting portion of the movable contact; and a connection agent connecting the mounting conductor to the mounting portion.

10. A switch comprising:

the movable contact of claim 1;

a base;

a first fixed contact provided on an upper surface of the base and below the dome portion; and a second fixed contact provided on the upper surface of the base and facing the contact portions of the movable contact.

11. The switch of claim 10, wherein the contact portions are substantially parallel to the second fixed contact.

12. The switch of claim 10, wherein the respective one of the contact portions extends from a boundary portion of the respective one of the contact portions connected to the each of the connection portions toward a tip end of the respective one of the contact portions while inclining in a direction away from the second fixed contact.

13. A movable contact comprising a conductive member having an outer end having substantially a rectangular shape when viewed from the conductive member, wherein the conductive member includes:

a dome portion having an upper surface which is convex upward, a lower surface which is concave upward, and an outer border;

a flange having an outer border and an inner border which is connected to the outer border of the dome portion, the flange extending from the inner border of the flange to the outer border of the flange in a direction away from the dome portion when viewed from above the conductive member;

connection portions provided at four corners of the rectangular shape of the conductive member, respectively, each of the connection portions having a lower border and an upper border which is connected to the outer border of the flange, the each of the connection portions protruding downward from the upper border of the each of the connection portions to the lower border of the each of the connection portions; and contact portions, respective one of the contact portions having an outer border and an inner border which is connected to the lower border of the each of the connection portions, the respective one of the contact portions extending from the inner border of the respective one of the contact portions to the outer border of the respective one of the contact portions away from the flange when viewed from above the conductive member, and a first boundary portion where the each of the connection portions is connected to the flange is curved to be concave toward the dome portion when viewed from above the conductive member, and a second boundary portion where the each of the connection portions is connected to the respective one of the contact portions is curved to be concave toward the dome portion when viewed from above the conductive member.

14. The movable contact of claim 13, further comprising:

a first extension portion protruding from the conductive member; and a mounting portion connected to the first extension portion, wherein the outer end of the conductive member having the rectangular shape has a first side and a second side opposite to each other, and the first extension portion protrudes from the first side.

15. The movable contact of claim 14, further comprising a second extension portion protruding from the second side of the outer end of the conductive member away from the first extension portion.

16. The movable contact of claim 14, wherein the contact portion is located below the mounting portion.

17. The movable contact of claim 14, wherein the first extension portion has a bent portion that is bent.

18. The movable contact of claim 14, wherein the first extension portion is bent between the flange and the mounting portion in a crank shape or an S-shape when viewed from above the conductive member.

19. The movable contact of claim 14, wherein the first extension portion is symmetrical with respect to a center line passing through a middle point of the first side perpendicularly to the first side, and the mounting portion is symmetrical with respect to the center line.

20. A switch comprising:

the movable contact of claim 14;

a base;

a first fixed contact provided on an upper surface of the base and locate below the dome portion of the movable contact;

a second fixed contact provided on the upper surface of the base and facing the contact portion of the movable contact;

a mounting conductor facing the mounting portion of the movable contact; and a connection agent connecting the mounting conductor to the mounting portion.

21. A switch comprising:

the movable contact of claim 13;

a base;

a first fixed contact provided on an upper surface of the base and below the dome portion; and a second fixed contact provided on the upper surface of the base and facing the contact portions of the movable contact.

22. The switch of claim 21, wherein the contact portions are substantially parallel to the second fixed contact.

23. The switch of claim 21, wherein the respective one of the contact portions extends from a boundary portion of the respective one of the contact portions connected to the each of the connection portions toward a tip end of the respective one of the contact portions while inclining in a direction away from the second fixed contact.

24. An embossed tape configured to accommodate a movable contact therein, the embossed tape comprising a base tape having an upper surface having an accommodation recess portion provided therein, the accommodation recess portion being configured to accommodate the movable contact therein, wherein the movable contact includes:

a conductive member having an outer end having substantially a rectangular shape when viewed from above the conductive member;

an extension portion protruding from the conductive member; and a mounting portion connected to the extension portion, the conductive member includes:

a dome portion having an upper surface which is convex upward, a lower surface which is concave upward, and an outer border;

a flange having an outer border and an inner border which is connected to the outer border of the dome portion, the flange extending from the inner border of the flange to the outer border of the flange in a direction away from the dome portion when viewed from above the conductive member;

connection portions provided at four corners of the rectangular shape of the conductive member, respectively, each of the connection portions having a lower border and an upper border which is connected to the outer border of the flange, the each of the connection portions protruding downward from the upper border of the each of the connection portions to the lower border of the each of the connection portions; and contact portions, respective one of the contact portions having an outer border and an inner border which is connected to the lower border of the each of the connection portion, the respective one of the contact portions extending from the inner border of the respective one of the contact portions to the outer border of the respective one of the contact portions away from the flange when viewed from above the conductive member, the accommodation recess portion includes:

a first recess portion having a first bottom surface and a first side wall connected to the first bottom surface, the first recess portion being configured to accommodate the flange of the movable contact therein;

a receiving portion provided on the first bottom surface of the first recess portion, the receiving portion being configured to receive a lower surface of the flange of the movable contact thereon;

a second recess portion having a second bottom surface and a second side wall connected to the second bottom surface, the second recess portion being connected to the first recess portion, the second recess portion being configured to accommodate the extension portion and the mounting portion of the movable contact therein; and regulator portions provided on the first side wall of the first recess portion, respective one of the regulator portions being configured to regulate a position of the respective one of the contact portions of the movable contact, and a gap between the respective one of the contact portions and the respective one of the regulator portions is smaller than a gap between the extension portion and the second side wall of the second recess portion and a gap between the mounting portion and the second side wall of the second recess portion.

25. The embossed tape of claim 24, wherein the second recess portion is recessed from the receiving portion.

26. The embossed tape of claim 25, wherein the second recess portion extends to a position facing the respective one of the contact portions.

* * * * *